US011183754B2

(12) United States Patent
Gomez et al.

(10) Patent No.: US 11,183,754 B2
(45) Date of Patent: Nov. 23, 2021

(54) RF ANTENNA ASSEMBLY AND SYSTEM

(71) Applicant: PC-TEL, Inc., Bloomingdale, IL (US)

(72) Inventors: Francisco X. Gomez, West Chicago, IL (US); Miroslav Parvanov, Naperville, IL (US)

(73) Assignee: PCTEL, Inc., Bloomingdale, IL (US)

( * ) Notice: Subject to any disclaimer, the term of this patent is extended or adjusted under 35 U.S.C. 154(b) by 31 days.

(21) Appl. No.: 16/569,126

(22) Filed: Sep. 12, 2019

(65) Prior Publication Data

US 2021/0083373 A1 Mar. 18, 2021

(51) Int. Cl.
*H01Q 1/42* (2006.01)
*H01Q 1/16* (2006.01)
*H01Q 1/36* (2006.01)

(52) U.S. Cl.
CPC ..... *H01Q 1/42* (2013.01); *H01Q 1/16* (2013.01); *H01Q 1/36* (2013.01)

(58) Field of Classification Search
CPC ..... H01Q 1/42; H01Q 1/16; H01Q 1/36
See application file for complete search history.

(56) References Cited

U.S. PATENT DOCUMENTS 3,781,894 A 12/1973 Ancona et al.
9,570,798 B1 2/2017 Johnson
2013/0265208 A1* 10/2013 Sawaya ..... H01Q 1/42 343/872
2013/0335276 A1* 12/2013 Lee ..... H01Q 1/243 343/702
2015/0280317 A1 10/2015 Morin et al.

FOREIGN PATENT DOCUMENTS

WO 85/03169 A1 7/1985

OTHER PUBLICATIONS

Electro-Metrics, Predict Specs—EM-6855 | Antenna, Omni Directional Wideband, Dec. 2016.
Sage Millimeter, Inc., Model SAO-2734030345-KF-S1, Ka-Band Omnidirectional Antenna, 45 Degree, 3 dBi Gain, Copyright ©2018 by SAGE Millimeter, Inc.
Extended European search report from corresponding patent application 20194372.7, dated Feb. 2, 2021.
English language translation of PCT patent application publication WO 85/03169, dated Jul. 18, 1985.

* cited by examiner

*Primary Examiner* — Seokjin Kim
(74) *Attorney, Agent, or Firm* — Husch Blackwell LLP

(57) ABSTRACT

An RF antenna assembly and system are provided that can employ cost-effective geometry and manufacturing methods to control tolerance variations, thereby precisely controlling an antenna element of the RF antenna assembly during manufacturing and operation and enabling the RF antenna system to properly operate at high frequencies, such as in a 6-67 GHz frequency range. The RF antenna assembly can include a top alignment collar, a bottom alignment collar coupled to the top alignment collar by a press fit connection, and the antenna element secured from movement in all degrees of freedom and aligned for consistent RF operation by the top alignment collar and the press fit connection.

20 Claims, 4 Drawing Sheets

RF ANTENNA ASSEMBLY AND SYSTEM

FIELD

The present invention generally relates to radio frequency (RF) communications hardware. More particularly, the present invention relates to an RF antenna assembly and system.

BACKGROUND

For RF antenna systems to properly operate at high frequencies, such as in a 6-67 GHz frequency range, it is necessary to precisely align RF antenna elements therein. Some known RF antenna systems use expensive waveguide-type biconical configurations to achieve such alignment. However, these systems are overly complex and require expensive, labor-intensive fabrication and manufacturing processes to achieve a precise alignment.

Other known RF antenna systems use a rigid foam spacer to align the RF antenna elements therein. However, these RF antenna systems are difficult to fabricate, and the rigid foam spacer is not sufficient to precisely align the RF antenna elements, which can shift in position due to various spacer factors, including dimensional inaccuracy from the manufacturing processes and compression displacement from compressive loading, thereby making it difficult to maintain a coaxial relationship between the RF antenna elements and producing a detrimental effect on performance and reliability of the RF antenna systems. In particular, lot to lot variations in a density of the rigid foam spacer can negatively impact a dielectric constant and a dissipation factor thereof, and end use stresses from impact and vibration can result in limited use or deployment of these antenna systems.

In view of the above, there is a continuing, ongoing need for improved antenna assemblies and systems.

DETAILED DESCRIPTION

Figure 1:
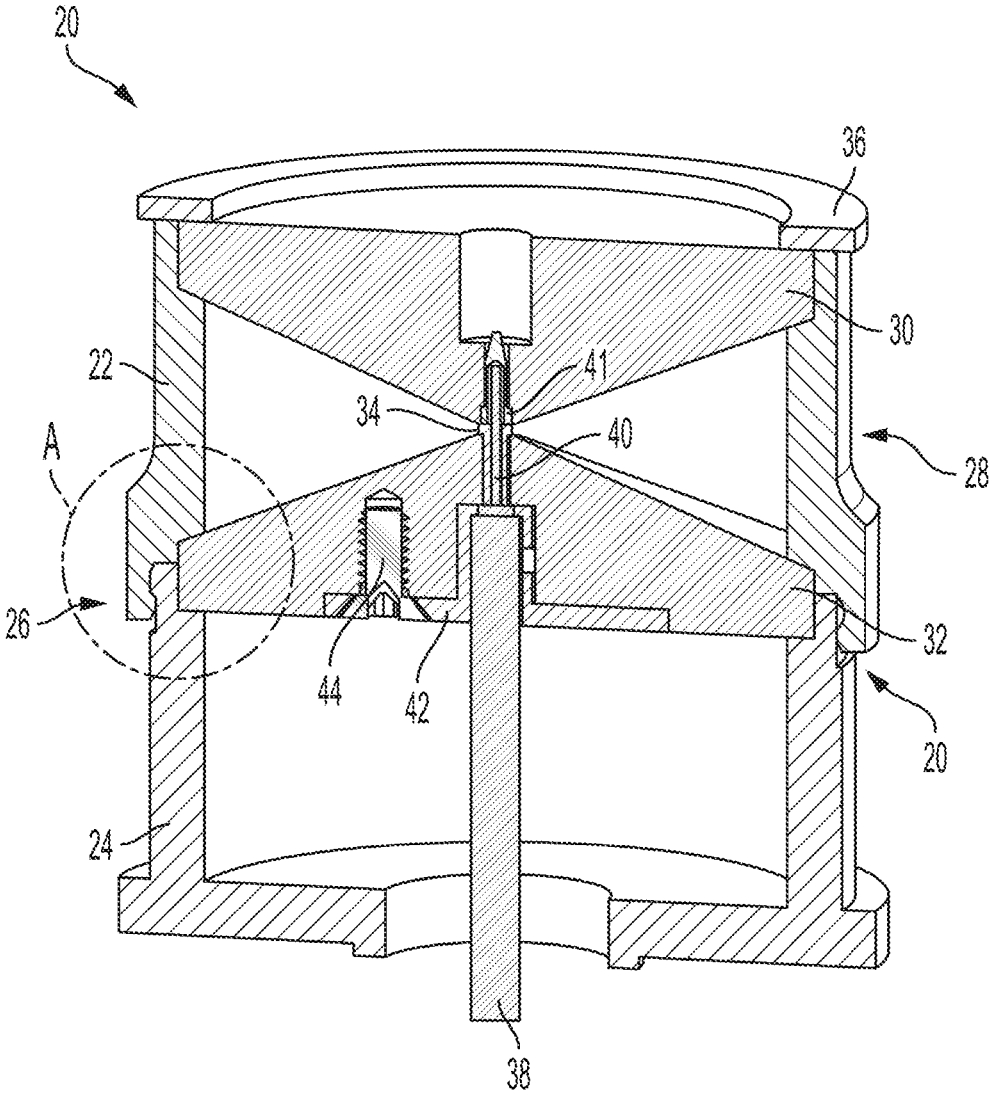
FIG. 1 is a cross-sectional view of an RF antenna assembly using conical elements according to disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include an RF antenna assembly and system that can employ cost-effective geometry and manufacturing methods to control tolerance variations, thereby precisely controlling an antenna element of the RF antenna assembly during manufacturing and operation. In particular, the RF antenna assembly and system described herein can include a top alignment collar and a bottom alignment collar that can secure and align the antenna element to provide features and electrical characteristics suitable for operation in a frequency range of 6-67 GHz. In some embodiments, the top alignment collar and the bottom alignment collar can have a cylindrical shape, and the antenna element can be biconical and include an upper cone and a lower cone that can be held together by a first annular snap connection or another press fit type connection between the top alignment collar and the bottom alignment collar.

In some embodiments, the top alignment collar, the bottom alignment collar, and a compression foam damping pad can restrict the upper cone and the lower cone in all degrees of freedom when assembled. For example, the first annular snap connection can snap the top alignment collar and the bottom alignment collar together in 360 degrees and can include a lead in surface for pre-registration during assembly. Furthermore, in some embodiments, a cross-section of the first annular snap connection can be coated with polytetrafluoroethylene (PTFE) and take advantage of a low coefficient of friction and self-lubricating properties of the PTFE, thereby requiring both a low axial insertion force and a high axial disassembly or removal force.

In some embodiments, the top alignment collar and the bottom alignment collar can be fabricated with precision machining, injection molding, isostatic and compression molding, or any other manufacturing method or process as would be known and understood by one of ordinary skill in the art. When assembled, the top alignment collar and the bottom alignment collar can minimize any misalignment of the antenna element that would otherwise result in poor RF performance over time and temperature.

In some embodiments, a semi-rigid coaxial cable subassembly can feed the antenna element and can be soldered to a grounding sleeve with precision machined features to control any wetting and flow of a resulting solder joint. Furthermore, in some embodiments, the grounding sleeve can telescope into the lower cone for a controlled RF solder transition from the semi-rigid coaxial cable to the lower cone, thereby alleviating any heat sink effects in the antenna element.

In some embodiments, a sleeve spacer can be inserted into the lower cone and onto a center conductor of the semi-rigid coaxial cable to guide the center conductor into precise coaxial alignment with and connection to the upper cone with a solderless contact. Furthermore, in some embodiments, the upper cone can include a press-fit receptacle that can receive, guide, and produce suitable pressure contact with the center conductor to produce a bulkhead connector configuration that can complete the antenna element. In some embodiments, the press-fit receptacle can include connector terminations, such as 2.4 or 2.92 K-type microwave connectors. However, other connecter terminations that account for different frequency ranges and desired performance levels are also contemplated.

In some embodiments, the RF antenna assembly, including the top alignment collar, the bottom alignment collar, and the antenna element, can be located within a housing that can include a base and a radome. Furthermore, in some embodiments, the base can include a threaded snap ring that can connect to the radome by a one-way snap fit connection to protect the RF antenna assembly from ingress of water and other outside elements and from degradation of the antenna element. For example, in some embodiments, the one-way snap fit connection can include a second annular snap connection. Additionally or alternatively, in some embodiments, the one-way snap fit connection can include an integrated O-ring seal between the radome and the threaded snap ring that can protect the RF antenna assembly from the ingress of the water and the other outside elements and that can limit rotation of the radome.

FIG. 1 is a cross-sectional view of an RF antenna assembly 20 using conical elements according to disclosed embodiments. As seen in FIG. 1, in some embodiments, the RF antenna assembly 20 can include an antenna element 28, a top alignment collar 22, and a bottom alignment collar 24 coupled to the top alignment collar 22 by a press fit connection 26. As further seen in FIG. 1, in some embodiments, the top alignment collar 22 and the press fit connection 26 can secure the antenna element 28 from movement in all degrees of freedom and align the antenna element 28 for consistent RF operation.

In some embodiments, the antenna element 28 can be biconical and include an upper cone 30 secured by the top alignment collar 22 and a lower cone 32 secured in the press fit connection 26 between the top alignment collar 22 and the bottom alignment collar 24. Furthermore, in some embodiments, the antenna element 28 can include a feed connection, including a feed cable 38, a grounding sleeve 42, and a sleeve spacer 34 between the lower cone 32 and the upper cone 30 such that the sleeve spacer 34 can establish a characteristic spacing between the lower cone 32 and the upper cone 30. In some embodiments, the sleeve spacer 34 can be coupled to a center conductor 40 of the feed cable 38 to align the center conductor 40 with a press-fit receptacle 41 of the upper cone 30 and to connect the center conductor 40 to the press-fit receptacle 41, and in some embodiments, a portion of the sleeve spacer 34 can be embedded in the lower cone 32.

In some embodiments, the grounding sleeve 42 can be coupled to the feed cable 38. Additionally, in some embodiments, the grounding sleeve 42 be coupled to the lower cone 32 by fasteners 44 embedded in the lower cone 32. For example, in some embodiments, the fasteners 44 can include three fastening elements separated by 120 degrees from each other, and in some embodiments, the grounding sleeve 42 can be at least partially embedded in the lower cone 32.

In some embodiments, the RF antenna assembly 20 can include a compression foam collar 36 coupled to a top of the top alignment collar 22 to secure the upper cone 30 in a precise alignment slot of a wall of the top alignment collar 22 and to align the upper cone 30 with the lower cone 32. Furthermore, in some embodiments, the compression foam collar 36 can include a low loss adhesive lined compression foam damping pad that can add vibration stability to the RF antenna assembly 20 and limit rotation of the upper cone 30.

Figure 2:
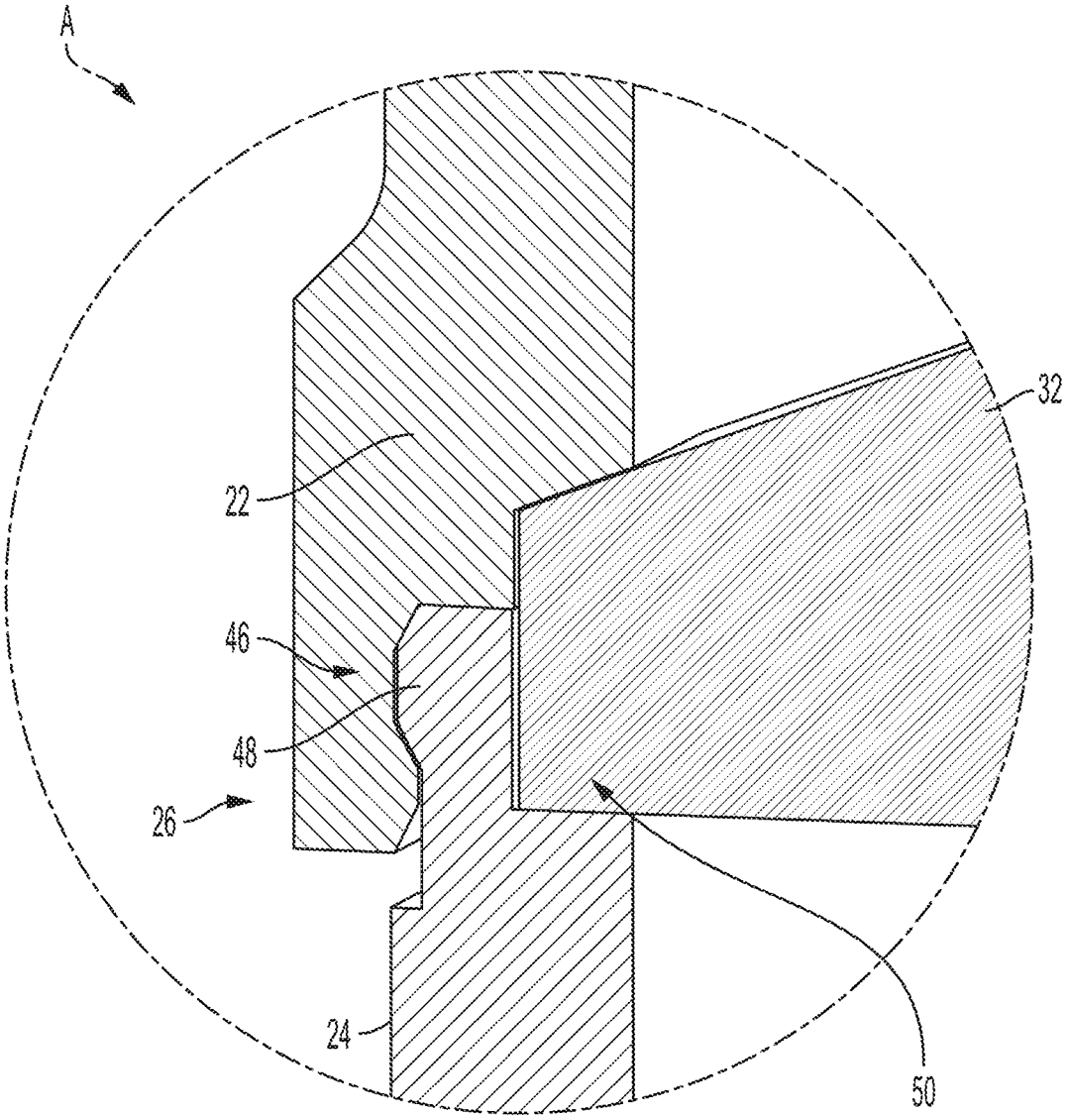
FIG. 2 is a cross-sectional view of a portion of an RF antenna assembly according to disclosed embodiments.

FIG. 2 is a cross-sectional view of section A of the RF antenna assembly 20 of FIG. 1. As seen in FIG. 2, in some embodiments, the press fit connection 26 can include a one-way snap fit connection, and in these embodiments, the top alignment collar 22 can include an annular retaining mechanism 46, and the bottom alignment collar 24 can include an annulus 48. For example, in some embodiments, the annulus 48 can engage with the annular retaining mechanism 46 to couple the bottom alignment collar 24 to the top alignment collar 22 and to create a precise alignment slot 50 within walls of the top alignment collar 22 and the bottom alignment collar 24 that can secure the lower cone 32 in the press fit connection 26 and align the lower cone 32 with the upper cone 30.

Figure 3:
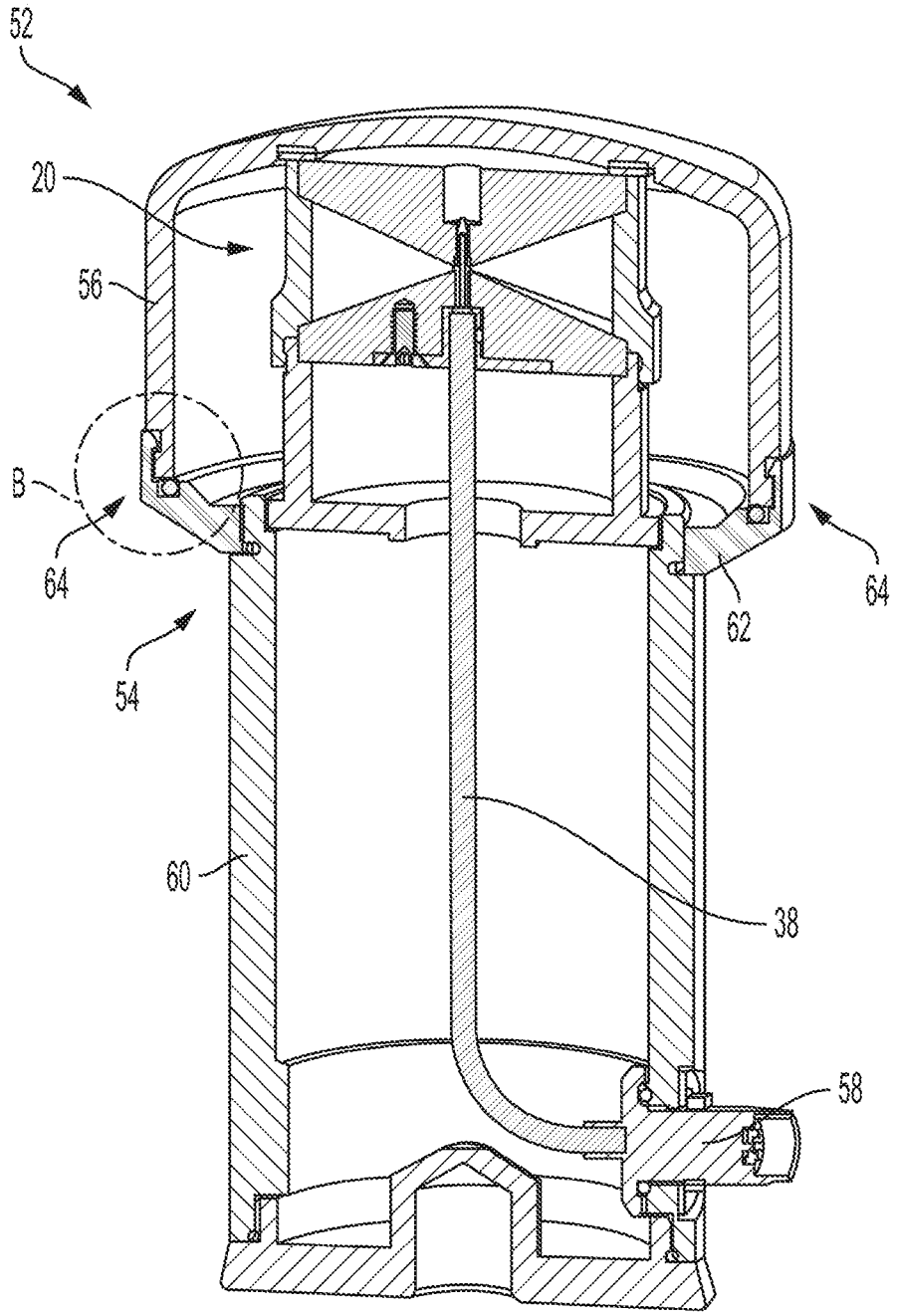
FIG. 3 is a cross-sectional view of an RF antenna system according to disclosed embodiments.

FIG. 3 is a cross-sectional view of an RF antenna system 52 according to disclosed embodiments. As seen in FIG. 3, the RF antenna system 52 can include a housing 54, a radome 56, and the RF antenna assembly 20. As further seen in FIG. 3, the feed cable 38 can be located within the housing 54, and the RF antenna assembly 20 can be supported by the housing 54 and covered by the radome 56. In some embodiments, the housing 54 can include a base 60 and a snap ring 62 threaded to the base 60, and as seen in FIG. 3, in some embodiments, the radome 56 can be coupled to the snap ring 62 by a one-way snap fit connection 64.

Figure 4:
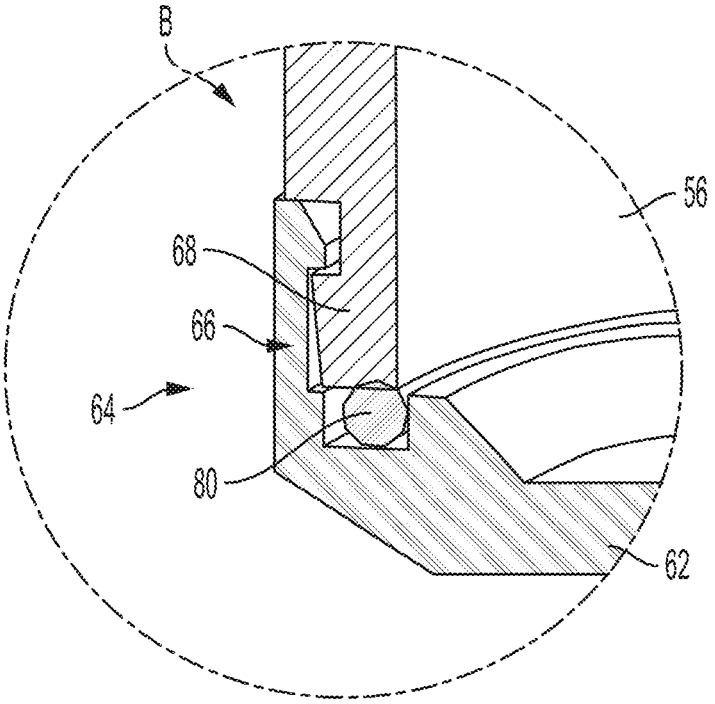
FIG. 4 is a cross-sectional view of a portion of an RF antenna system according to disclosed embodiments.

FIG. 4 is a cross-sectional view of section B of the RF antenna system 52 of FIG. 3. As seen in FIG. 4, in some embodiments, the snap ring 62 can include an annular retaining mechanism 66, and the radome 56 can include an annulus 68. In operation, the annulus 68 can engage with the annular retaining mechanism 66 to couple the radome 56 to the housing 54, and in some embodiments, an O-ring 80 can be integrated between the radome 56 and the snap ring 62 to seal the housing 54.

Figure 5:
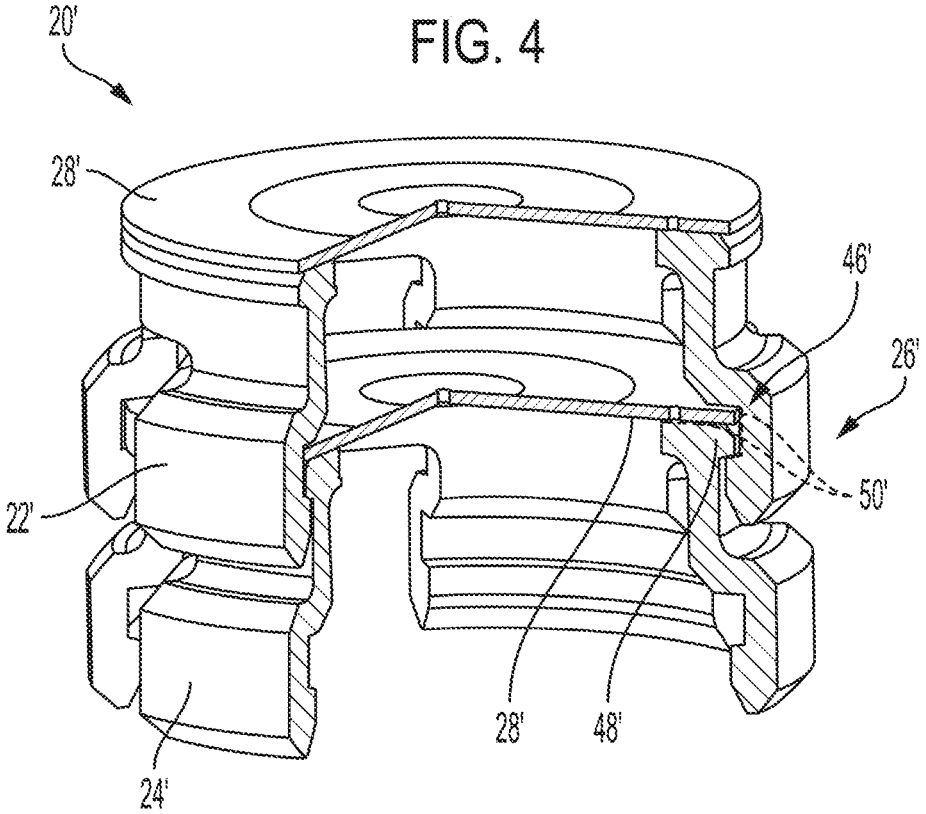
FIG. 5 is a cross-sectional view of an RF antenna assembly using disc elements according to disclosed embodiments.

Finally, FIG. 5 is a cross-sectional view of an RF antenna assembly 20' using disc elements according to disclosed embodiments. As seen in FIG. 5, in some embodiments, the RF antenna assembly 20' can include a top alignment collar 22' and a bottom alignment collar 24' coupled to the top alignment collar 22' by a connection 26'. As further seen in FIG. 5, in some embodiments, the top alignment collar 22' and the connection 26' can secure an antenna element 28' from movement in all degrees of freedom and align the antenna element 28' for consistent RF operation. In some embodiments, the antenna element 28' can include a disc secured within the connection 26' between the top alignment collar 22' and the bottom alignment collar 24'.

In some embodiments, the connection 26' can be threaded. Additionally or alternatively, in some embodiments, the connection 26' can include a one-way snap fit connection, and in these embodiments, the top alignment collar 22' can include an annular retaining mechanism 46', and the bottom alignment collar 24' can include an annulus 48'. For example, in some embodiments, the annulus 48' can engage with the annular retaining mechanism 46' to couple the bottom alignment collar 24' to the top alignment collar 22' and to create a precise alignment slot 50' that can secure the antenna element 28' within the connection 26'.

As seen in FIG. 5, in some embodiments the top alignment collar 22' and the bottom alignment collar 24' can be identical and used as spacers in an antenna system employing a plurality of antenna elements 28'. In these embodiments, the antenna element 28' can be molded into or onto the top alignment collar 22' and/or the bottom alignment collar 24' to provide versatility and control of a respective spacing between each of the plurality of antenna elements 28', thereby shifting control of the respective spacing between each of the plurality of antenna elements 28' to a molding operation during manufacture.

Although a few embodiments have been described in detail above, other modifications are possible. For example, other components may be added to or removed from the described systems, and other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. An RF antenna assembly comprising:

a top alignment collar;

a bottom alignment collar coupled to the top alignment collar by an annular press fit connection; and an antenna element secured from movement in all degrees of freedom and aligned for consistent RF operation by the top alignment collar and the annular press fit connection, wherein the annular press fit connection includes a one-way snap fit connection, wherein the top alignment collar includes an annular retaining mechanism of the one-way snap fit connection, wherein the bottom alignment collar includes an annulus of the one-way snap fit connection, and wherein the annulus engages with the annular retaining mechanism to couple the bottom alignment collar to the top alignment collar and to create a precise alignment slot within walls of the top alignment collar and the bottom alignment collar.

2. The RF antenna assembly of claim 1 wherein the antenna element includes a disc secured within the annular press fit connection between the top alignment collar and the bottom alignment collar.

3. An RF antenna assembly comprising:

a top alignment collar;

a bottom alignment collar coupled to the top alignment collar by an annular press fit connection; and an antenna element secured from movement in all degrees of freedom and aligned for consistent RF operation by the top alignment collar and the annular press fit connection, wherein the antenna element is biconical and includes an upper cone secured by the top alignment collar and a lower cone secured in the annular press fit connection between the top alignment collar and the bottom alignment collar.

4. The RF antenna assembly of claim 3 wherein the antenna element includes a sleeve spacer between the lower cone and the upper cone, wherein the sleeve spacer is coupled to a center conductor of a feed cable, and wherein the sleeve spacer aligns the center conductor with a press-fit receptacle of the upper cone and connects the center conductor to the press-fit receptacle.

5. The RF antenna assembly of claim 4 wherein a portion of the sleeve spacer is embedded in the lower cone.

6. The RF antenna assembly of claim 4 further comprising:

a grounding sleeve coupled to the feed cable and to the lower cone by fasteners embedded in the lower cone.

7. The RF antenna assembly of claim 6 wherein the grounding sleeve is at least partially embedded in the lower cone.

8. The RF antenna assembly of claim 3 wherein the annular press fit connection includes a one-way snap fit connection, wherein the top alignment collar includes an annular retaining mechanism of the one-way snap fit connection, wherein the bottom alignment collar includes an annulus of the one-way snap fit connection, and wherein the annulus engages with the annular retaining mechanism to couple the bottom alignment collar to the top alignment collar and to create a precise alignment slot within walls of the top alignment collar and the bottom alignment collar that secures the lower cone in the annular press fit connection and aligns the lower cone with the upper cone.

9. The RF antenna assembly of claim 3 further comprising:

a compression foam collar coupled to a top of the top alignment collar to secure the upper cone in a precise alignment slot of a wall of the top alignment collar and to align the upper cone with the lower cone.

10. The RF antenna assembly of claim 1 wherein the annular press fit connection includes a one-way snap fit connection.

11. An RF antenna system comprising:

a housing;

a radome coupled to the housing by a first one-way snap fit connection;

a feed cable; and an RF antenna assembly supported by the housing, coupled to the feed cable, and covered by the radome, wherein the RF antenna assembly includes a top alignment collar, a bottom alignment collar coupled to the top alignment collar by a second, annular one-way snap fit connection, and an antenna element secured from movement in all degrees of freedom and aligned for consistent RF operation by the top alignment collar and the second, annular one-way snap fit connection.

12. The RF antenna system of claim 11 wherein the antenna element is biconical and includes an upper cone secured by the top alignment collar and a lower cone secured in the second, annular one-way snap fit connection between the top alignment collar and the bottom alignment collar.

13. The RF antenna system of claim 12 wherein the antenna element includes a sleeve spacer between the lower cone and the upper cone, wherein the sleeve spacer is coupled to a center conductor of a feed cable, and wherein the sleeve spacer aligns the center conductor with a press-fit receptacle of the upper cone and connects the center conductor to the press-fit receptacle.

14. The RF antenna system of claim 13 wherein a portion of the sleeve spacer is embedded in the lower cone.

15. The RF antenna system of claim 12 further comprising:

a grounding sleeve coupled to the feed cable and to the lower cone by fasteners embedded in the lower cone.

16. The RF antenna system of claim 15 wherein the grounding sleeve is at least partially embedded in the lower cone.

17. The RF antenna system of claim 12 wherein the top alignment collar includes an annular retaining mechanism of the second, annular one-way snap fit connection, wherein the bottom alignment collar includes an annulus of the second, annular one-way snap fit connection, and wherein the annulus engages with the annular retaining mechanism to couple the bottom alignment collar to the top alignment collar and to create a precise alignment slot within walls of the top alignment collar and the bottom alignment collar that secures the lower cone in the second, annular one-way snap fit connection and aligns the lower cone with the upper cone.

18. The RF antenna system of claim 12 further comprising:

a compression foam collar coupled to a top of the top alignment collar to secure the upper cone in a precise alignment slot of a wall of the top alignment collar and to align the upper cone with the lower cone.

19. The RF antenna system of claim 11 wherein the antenna element includes a disc secured within the second, annular one-way snap fit connection between the top alignment collar and the bottom alignment collar.

20. The RF antenna system of claim 11 wherein the housing includes a snap ring threaded onto a base, wherein the snap ring includes an annular retaining mechanism of the first one-way snap fit connection, wherein the radome includes an annulus of the second, annular one-way snap fit connection, wherein the annular retaining mechanism snaps around the annulus to couple the radome to the housing, and wherein an O-ring is disposed between the radome and the snap ring to seal the housing.

* * * * *